US008632432B2

(12) United States Patent
Bissig et al.

(10) Patent No.: US 8,632,432 B2
(45) Date of Patent: Jan. 21, 2014

(54) FLAT-BELT-LIKE SUPPORTING AND DRIVE MEANS WITH TENSILE CARRIERS

(75) Inventors: Adolf Bissig, Buochs (CH); Alessandro D'Apice, Adligenswil (CH); Herbert Bachmann, Lucerne (CH); Manfred Wirth, Rotkreuz (CH); Roland Lorenz, Root (CH); Tobias Noseda, Lucerne (CH); Florian Dold, Root (CH); Claudio De Angelis, Münster (DE)

(73) Assignee: Inventio AG, Hergiswil (CH)

( * ) Notice: Subject to any disclaimer, the term of this patent is extended or adjusted under 35 U.S.C. 154(b) by 1214 days.

(21) Appl. No.: 11/863,596

(22) Filed: Sep. 28, 2007

(65) Prior Publication Data

US 2008/0081721 A1 Apr. 3, 2008

(30) Foreign Application Priority Data

Sep. 29, 2006 (EP) ..... 06121578

(51) Int. Cl.
*F16G 1/08* (2006.01)

(52) U.S. Cl.
USPC ..... 474/260; 474/202; 474/205; 474/237; 474/263; 474/264; 187/251; 187/254; 187/411

(58) Field of Classification Search
USPC ..... 474/260; 57/223; 187/266
IPC ..... F16G 1/08; D07B 1/16,1/22
See application file for complete search history.

(56) References Cited

U.S. PATENT DOCUMENTS

| | | | | |
|---|---|---|---|---|
| 4,266,396 | A | 5/1981 | Thomson | |
| 4,711,346 | A * | 12/1987 | Breher et al. | 198/850 |
| 6,318,504 | B1 * | 11/2001 | De Angelis | 187/254 |
| 6,321,520 | B1 | 11/2001 | De Angelis | |
| 6,488,123 | B2 * | 12/2002 | Pitts et al. | 187/251 |
| 6,508,051 | B1 * | 1/2003 | De Angelis | 57/223 |
| 6,513,792 | B1 * | 2/2003 | De Angelis | 254/374 |
| 2003/0203781 | A1 * | 10/2003 | Welk et al. | 474/237 |
| 2004/0083707 | A1 | 5/2004 | Eichhorn et al. | |
| 2007/0084671 | A1 * | 4/2007 | Ach | 187/261 |
| 2008/0135343 | A1 * | 6/2008 | Ach | 187/266 |

FOREIGN PATENT DOCUMENTS

| | | |
|---|---|---|
| CL | 191-79 | 3/1979 |
| CL | 191-90 | 3/1990 |
| CL | 37.427 | 6/1998 |
| CL | 2275-99 | 10/1999 |
| CN | 1262358 A | 8/2000 |
| CN | 1294270 A | 5/2001 |
| EP | 0 995 832 A | 4/2000 |
| EP | 1 061 172 | 4/2000 |

(Continued)

*Primary Examiner* — Robert A Siconolfi
*Assistant Examiner* — San Aung
(74) *Attorney, Agent, or Firm* — Fraser Clemens Martin & Miller LLC; William J. Clemens

(57) ABSTRACT

A supporting and drive belt including a belt body or sheathing which encloses tensile carriers. The running surface of the belt can be flat and parallel to the belt back or have trapezium-shaped or semicircular ribs and grooves, wherein the profile of a drive pulley or of a deflecting pulley is approximately complementary to the running surface of the belt. One or more tensile carriers are provided for each rib, wherein the tensile carriers are laid or stranded alternately in the "Z" direction and the "S" direction.

11 Claims, 4 Drawing Sheets

(56) References Cited

FOREIGN PATENT DOCUMENTS

| | | | |
|---|---|---|---|
| EP | 0 995 832 | | 12/2000 |
| EP | 1 061 172 | A | 12/2000 |
| WO | 2004/035913 | | 4/2004 |
| WO | WO 2004/035913 | A | 4/2004 |
| WO | WO 2005/066060 | A1 | 7/2005 |
| WO | WO 2005066060 | A1 * | 7/2005 |

* cited by examiner

FIG. 4
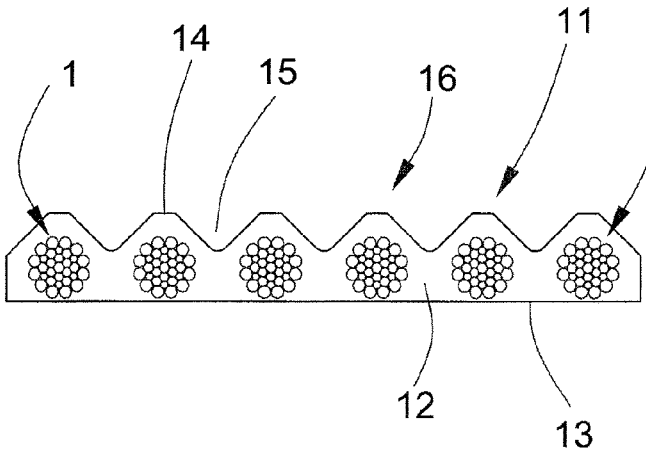
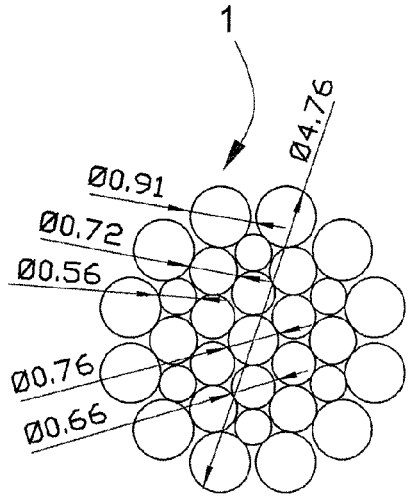
FIG. 4A
FIG. 5
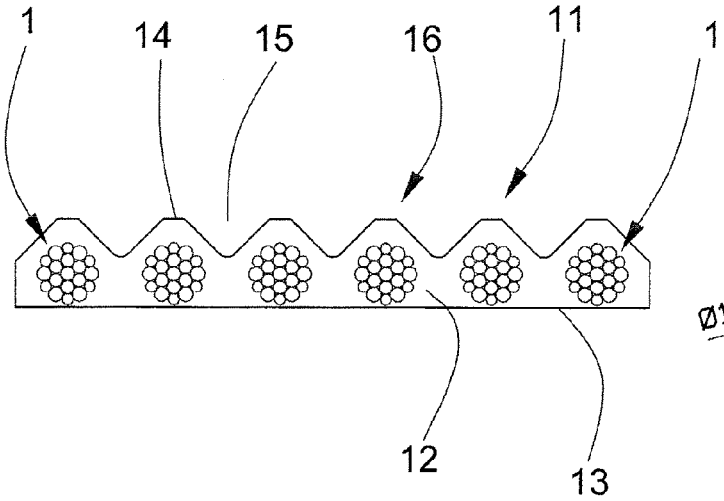
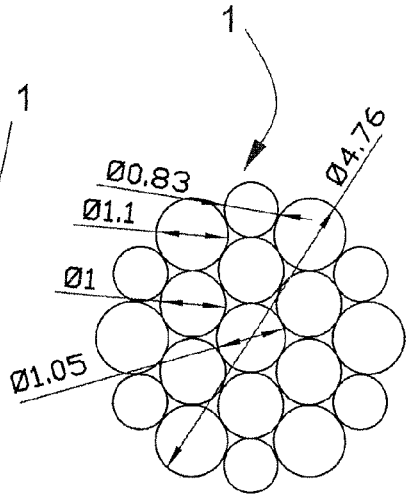
FIG. 5A

FIG. 6
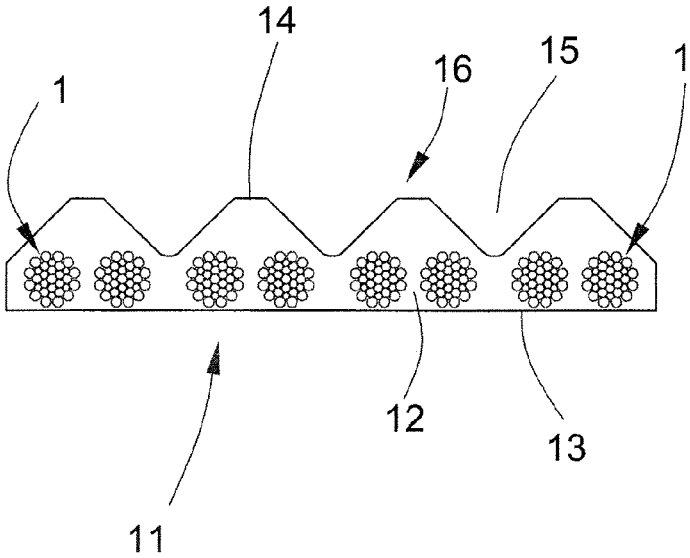
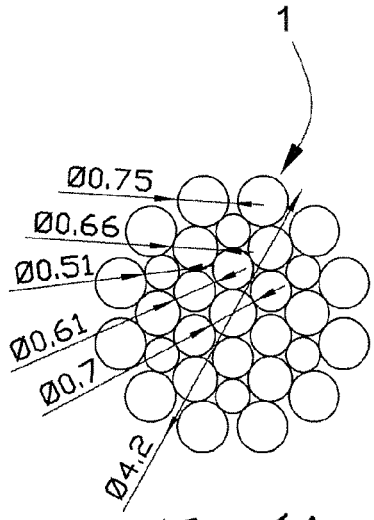
FIG. 6A
FIG. 7
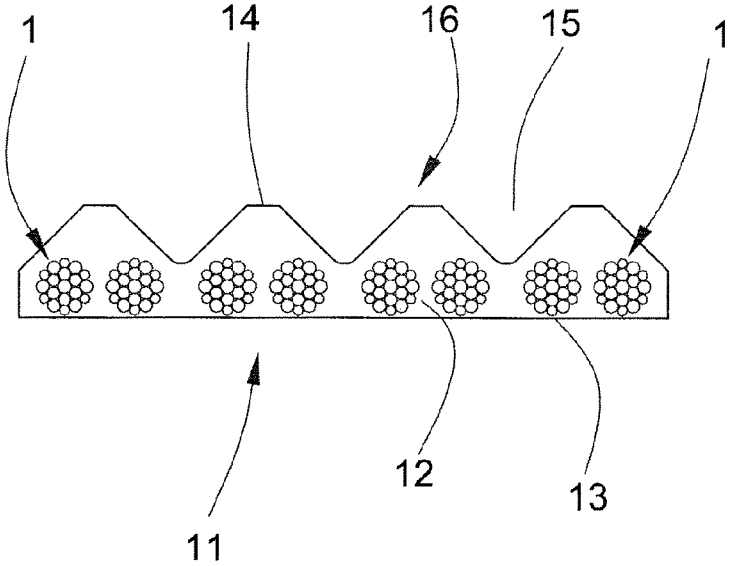
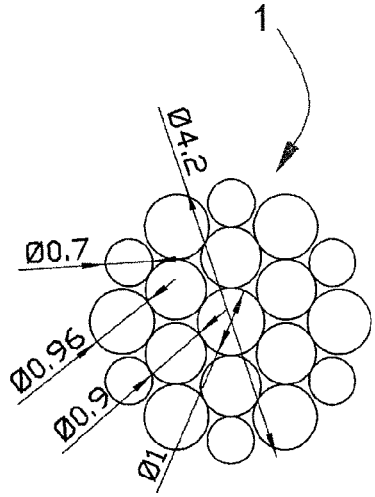
FIG. 7A

FLAT-BELT-LIKE SUPPORTING AND DRIVE MEANS WITH TENSILE CARRIERS

FIELD OF THE INVENTION

The present invention relates to a flat-belt-like supporting and drive means with at least two tensile carriers of synthetic fibers, wherein the tensile carriers extend at a spacing from one another axially parallel to the longitudinal axis of the supporting and drive means and are embedded in a sheathing.

BACKGROUND OF THE INVENTION

A flat-belt-like supporting and drive means with tensile carriers of synthetic fibers is known from the specification WO 2004/035913 A1, wherein provided as tensile carriers are at least two unstranded strands which comprise stranded synthetic fiber threads and are designed for accepting force in a longitudinal direction. The strands are arranged at a spacing from one another along the longitudinal direction of the supporting and drive means and are embedded in a common sheathing. At least one of the strands has an electrically conductive indicator thread which is stranded together with the synthetic fiber threads of the strand, wherein the indicator thread is arranged outside the center of the thread bundle. The indicator thread has a ductile yield limit lower than the ductile yield limit of the individual synthetic fiber threads of the strands. Electrical contact can be made with the indicator thread so to enable electrical monitoring of its integrity.

A synthetic fiber cable for drive by a drive pulley has become known from the specification EP 1 061 172 A2. The synthetic fiber cable is constructed as a double cable from two cables which are stranded in opposite rotational directions and which are fixed to one another—secure against twisting and in their parallel, spaced-apart position—by a common cable sheathing. The cable sheathing constructed in accordance with the invention integrally over both cables acts as a torque bridge which under longitudinal loading of the double cable mutually cancels torques, which arise due to the cable construction and are oppositely oriented, of the cables and thus creates over the overall cross-section of the double cable a torque compensation between the total of all right-hand and left-hand strand components. The double cable behaves in a rotation-free manner during running over a cable pulley.

SUMMARY OF THE INVENTION

The present invention fulfils the object of creating a supporting and drive means with lower bending stresses in the tensile carriers.

Previous attempts to produce a belt with impregnated aramide strands as tensile carriers have failed due to the bending stresses occurring during running over a drive pulley or over a deflecting pulley. The tensile carriers consisted of unstranded aramide strands with a relatively large diameter.

In the bending of a strand around the drive pulley or around the deflecting pulley the strand half at the pulley side is exposed to compressive stresses and the free strand half to tensile stresses. The neutral fiber loaded neither in compression nor tension runs between the strand halves loaded in compression and loaded in tension. Excessive compressive/tensile stresses in the strand lead to premature failure of the strand.

In the supporting and drive means according to the present invention the bending stresses in the strands of the tensile carriers during running over the drive pulley or the deflecting pulley are reduced and thus a smaller pulley diameter is possible. This leads to a smaller required drive torque at the drive pulley, which is accompanied by a smaller drive engine. A smaller drive engine is more economic and needs less space.

Each tensile carrier consists of several strand layers, wherein the strands forming the strand layer are stranded (helical twisting around one another of strands of a strand layer about the strand layer lying thereunder). Each strand consists of several thread layers, wherein the threads forming the thread layer are stranded (helical twisting around one another of threads of a thread layer about the thread layer lying thereunder). Each thread consists of several unidirectional or unstranded synthetic fibers, also termed filaments. Each thread is impregnated in a synthetic material bath. The synthetic material encasing a thread or a strand is also termed matrix or matrix material. After stranding of the threads to form a strand the synthetic material of the threads is homogenized by means of a heat treatment. The strand then consists of stranded threads completely embedded in the synthetic material.

A strand consists of stranded threads which in turn consist of unstranded or unidirectional synthetic fibers, wherein a thread consists of, for example, 1,000 synthetic fibers, also termed filaments. The stranding direction of the threads in the strand is provided so that the individual fiber is oriented in the tension direction of the cable or in the cable longitudinal axis. Each thread is impregnated in a synthetic material bath. The synthetic material surrounding a thread or strand is also termed matrix or matrix material. After stranding of the threads to form a strand the synthetic material of the threads is homogenized by means of a heat treatment. The strand then has a smooth strand surface and then consists of stranded threads completely embedded in the synthetic material.

The fibers are connected together by the matrix, but do not have direct contact with one another. The matrix completely encloses or embeds the fibers and protects the fibers from abrasion and wear. Due to the cable mechanics, displacements occur between the individual fibers in the stands. These displacements are not translated by way of a relative movement between the filaments, but by a reversible stretching of the matrix.

The stranding of threads to form a strand is termed a first stranding stage. The stranding of strands to form a tensile carrier or to form a cable is termed a second stranding stage. The tensile carriers can be built up from chemical fibers such as, for example, aramide fibers, Vectran (Kuraray Co., Ltd., Japan) fibers, polyethylene fibers, polyester fibers, etc.

For reducing the bending stress, the tensile carrier consists of thin strands stranded for each strand layer, wherein each strand consists of threads stranded for each thread layer. The smaller the diameter of the strand, the smaller the bending stresses resulting from bending around the drive pulley or around the deflecting pulley. By means of smaller strand diameters and a multi-layered (double-layered, triple-layered or quadruple-layered) construction of the tensile carriers the relative movements, which lead to wear of the strands, from strand to strand can be kept small. A high service life of the tensile carriers is thus ensured. Moreover, some of the strands have, by virtue of the size factor, a higher tensile strength than strands with large diameter, which advantageously has the consequence of a higher breakage force.

The supporting and drive means for uses in elevator construction, particularly as supporting and drive means for the elevator car and the counterweight, can have, for example, the geometry of a flat belt or a ribbed belt or the geometry of a cogged belt. Other current belt geometries are also conceivable. The tensile carriers are arranged adjacent to one another in the belt, wherein the tensile carriers are laid or stranded alternately in an "S" direction and a "Z" direction and lie relatively closely adjacent to one another. Depending on the respective belt geometry, at least two, preferably between four and twelve, tensile carriers are provided.

These tensile carriers are built up as explained further above as a fiber composite, wherein the synthetic material (matrix material) surrounding the strands is preferably of polyurethane and lies in the hardness range of 50D to 75D and the fibers accepting the tension forces are preferably of aramide. For reduction in the coefficient of friction and the wear, between 1% and 10% Teflon (registered trademark of E. I. du Pont de Nemours and Company, Wilmington, Del.) material is admixed to the matrix material. Other additives such as wax or "Teflon" powder are also usable.

Moreover, a connection exists between the Shore hardness of the sheathing and the Shore hardness of the matrix. The sheathing can have a Shore hardness of 72A to 95A and the matrix a Shore hardness of 80A to 98A. If the material hardnesses of sheathing and matrix approach one another, then, as has emerged from tests, an improved connection between sheathing and matrix is achieved. If a too-hard sheathing material is used, promotion of cracks has to be taken into account. If the matrix material of the strands, which are stranded to form a tensile carrier, is selected to be too soft, this leads to increased wear of the strands and a considerable reduction in service life. The pairing of Shore hardnesses 85A for the sheathing and 95A (which corresponds with a Shore hardness 54D) for the matrix has proved ideal.

The tensile carriers are laid or stranded in the "S" direction and the "Z" direction in alternation for avoidance of torques in the supporting and drive means. The torque of one tensile carrier twists in opposite direction to the first of the other tensile carrier, so that the torques mutually cancel. The supporting and drive means neutral in torque does not twist due to the introduction of a tension force. In addition, two or three tensile carriers stranded in the "S" direction and two or three tensile carriers stranded in the "Z" direction can be arranged adjacent to one another. It is critical that the stranding in the "S" direction and the "Z" direction is neutral in torque relative to the longitudinal axis extending in the center of the supporting and drive means.

An optimum ratio of lay length of the strand layers to the diameter "D" of the drive pulley or deflecting pulley is additionally advantageous. The lay length "SL" depends on the necessary number "n" of lay lengths resting on the drive pulley or deflecting pulley, on the pulley diameter "D" and on the angle alpha of looping:

$$SL=(Pi\cdot D\cdot \text{alpha})/(n\cdot 360°)$$

"n" has been determined from tests and lies in the range of 2 to 5.

The lay length "SL" is also connected with the "E" modulus of the synthetic fibers. With increasing "E" modulus a smaller lay length can be selected for an unchanged fiber cross-sectional area without the spring stiffness of the support means being reduced. The lay length "SL" is usually between 4 to 10 times the tensile carrier diameter "d". SL=(4 to 10)×d, and the ratio D/d amounts to 10 to 50 (drive pulley diameter "D" to tensile carrier diameter "d").

The pressure "p" of the tensile carrier on the drive pulley is calculated according to the following formula:

$$p=2\times F\times k/(d\times D)$$

F=maximum occurring static tension force
d=tensile carrier diameter
D=drive pulley diameter or pulley diameter
k=amplification factor>=1 (depending on the groove geometry)
"p" can adopt values between 2 to 50 MPa.

The supporting and drive means according to the present invention is flat-belt-like and consists of at least two tensile carriers of synthetic fibers, wherein the tensile carriers extend at a spacing from one another axially parallel to the longitudinal axis of the supporting and drive means and are embedded in a sheathing, and each tensile carrier consists of several strands, wherein each strand is formed from several stranded threads.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIGS. 4 and 4A are an example of an embodiment of a supporting and drive means with a triple-layered tensile carrier per rib according to the present invention;

FIGS. 5 and 5A are an example of another embodiment of a supporting and drive means with a double-layered tensile carrier per rib;

FIGS. 6 and 6A are an example of an embodiment of a supporting and drive means with two triple-layered tensile carriers per rib; and FIGS. 7 and 7A are an example of embodiment of a supporting and drive means with two double-layered tensile carriers per rib.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
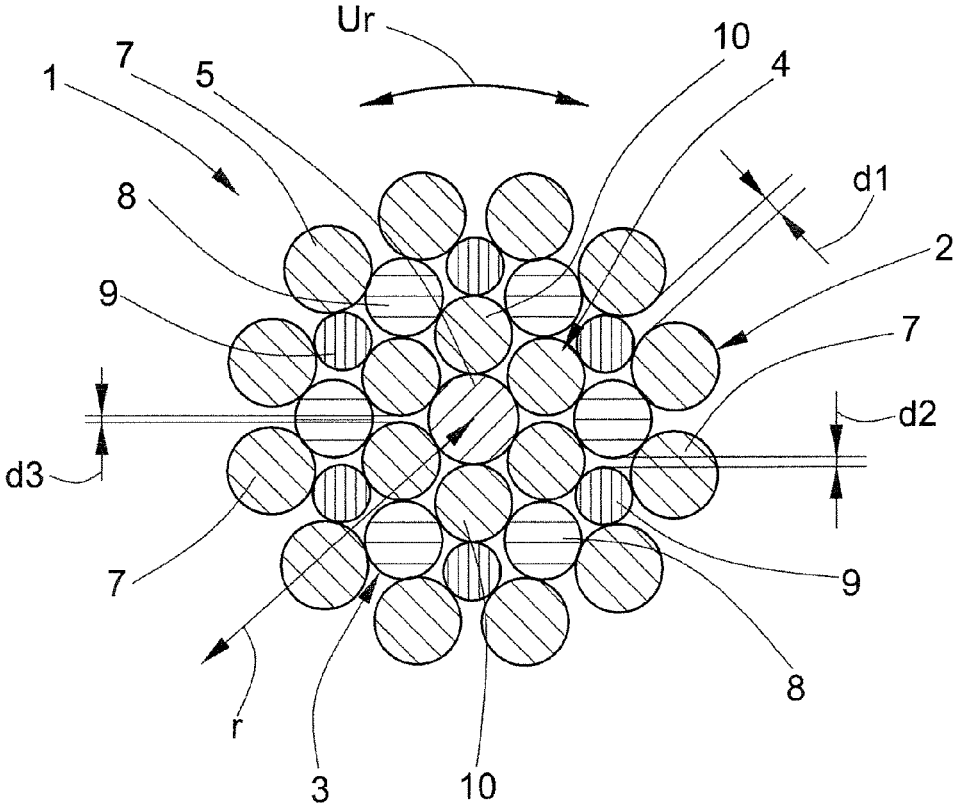
FIG. 1 is a cross-sectional view of the construction of a tensile carrier according to the present invention.

FIG. 1 shows the construction of a tensile carrier 1. The tensile carrier 1 comprises several strand layers, an outer strand layer 2, a first inner strand layer 3, a second inner strand layer 4 and a core layer 5. A sheathing is denoted by 6. Construction and diameter of the strands 7 of the outer strand layer 2 are the same. The first inner strand layer consists of, in diameter, larger strands 8 and smaller strands 9. The larger strands 8 approximately correspond in diameter with the strands 10 of the second inner strand layer 4 and the core layer 5. The strands 7 of the outer strand layer 2 are larger in diameter than the larger strands 8 of the first inner strand layer 3 and the strands 10 of the second inner strand layer 4. The larger strands 8 of the inner strand layers 3, 4 are larger in diameter than the smaller strands 9 of the first inner strand layer 3. The larger strands 8 of the first inner strand layer 3 and the strands 10 of the second inner strand layer 4 are approximately the size in diameter as the core layer 5. The strands 10 of the second inner strand layer 4 are stranded around the core layer 5, the strands 8, 9 of the first inner strand layer 3 are stranded around the second strand layer 4 and the strands 7 of the outer strand layer 2 are stranded around the first inner strand layer 3.

A strand 5, 7, 8, 9, 10 consists of stranded threads, which in turn consist of unstranded or unidirectional synthetic fibers. The tensile carriers 1 can be built up from chemical fibers such as, for example, aramide fibers, Vectran fibers, polyethylene fibers, polyester fibers, etc. The tensile carrier 1 can also consist of one or two or more than three strand layers.

FIG. 1 shows the tensile carriers in which the strands of a strand layer are mutually spaced apart. The spacing between two strands 7 of the outer strand layer 2 is denoted by d1. The spacing between two strands 8, 9 of the first inner layer 3 is denoted by d2. The spacing between two strands 10 of the second inner strand layer 4 is denoted by d3. d1 can lie in the range of, for example, 0.05 millimeters to 0.3 millimeters and d2 and d3 in the range of 0.01 millimeters to 0.08 millimeters.

With the mutual spacing, the strands 7 of the outer strand layer 2 can move in radial direction r in the direction of the cable center and exert a radial pressure on the strands 8, 9 of the first inner strand layer 3. The radial pressure is passed on by the strands 8, 9 of the first inner strand layer 3 to the strands 10 of the second inner strand layer 4. The radial pressure is passed on by the strands 10 of the second inner strand layer 4 to the core layer 5. The radial pressure increases inwardly from strand layer to strand layer.

Should the strands 7, 8, 9, 10 of the respective strand layer hit against one another as seen in circumferential direction Ur, the traction forces could not be transferred from the strands 7 of the outer strand layer 2 to the strands 8, 9 of the first inner strand layer 3 or from these to the strands 10 of the second inner strand layer 4 and further to the core strand 5.

Figure 2:
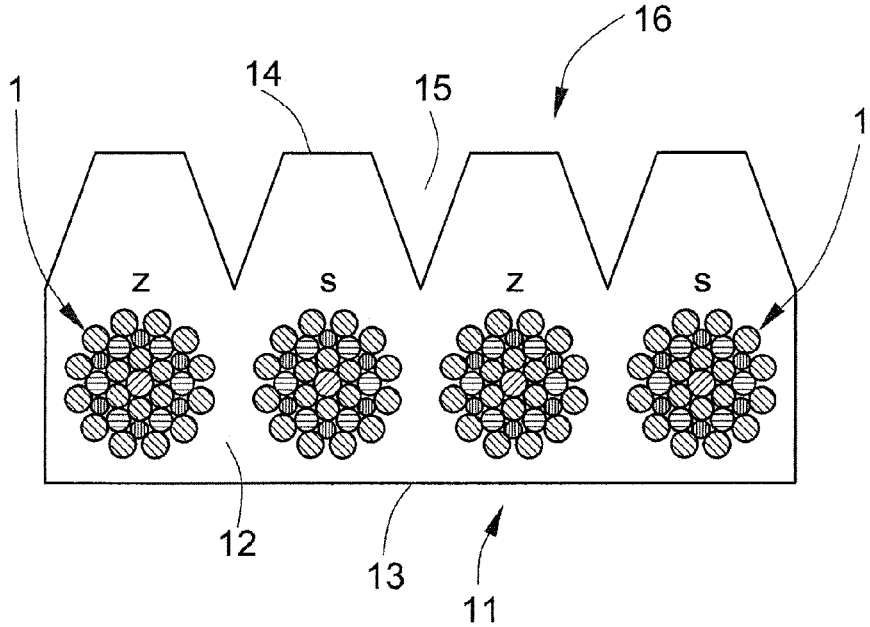
FIG. 2 is a schematic illustration of a supporting and drive means with the tensile carriers of FIG. 1.

FIG. 2 shows a schematic illustration of a supporting and drive means 11 with at least two tensile carriers 1 according to FIG. 1, which extend axially parallel to the longitudinal axis of the supporting and drive means. The supporting and drive means 11 has the geometry of a flat belt consisting of a belt body 12 or sheathing 12, which encloses the tensile carriers 1 or in which the tensile carriers 1 are embedded. The belt back is denoted by 13. The running surface of the belt can be flat and parallel to the belt back 13 or, as illustrated in FIG. 2, have trapezium-shaped ribs 14 and grooves 15, which run axially parallel to the tensile carriers 1, wherein the profile of the drive pulley or the deflecting pulley is matched to be approximately complementary to the profile of the running surface 16 of the belt 11. A drive pulley or a deflecting pulley form in conjunction with the belt 11 a force lock. One tensile carrier 1 is provided per rib 14, wherein the tensile carriers 1 are laid or stranded alternately in the "Z" direction and the "S" direction. Instead of the trapezium-shaped ribs 14 shown in FIG. 2, semicircular ribs could also be provided. In a cogged belt the ribs 14 and grooves 15 run transversely or obliquely relative to the tensile carriers 1. Drive pulley or deflecting pulley in conjunction with the belt 11 form a shape lock.

As explained above and as illustrated in FIG. 3, the tensile carriers 1 in the belt 11, 111 are laid or stranded in alternation in the "S" direction and the "Z" direction. The strands 7 of the outer strand layer 2 are laid in the same direction as the strands 8, 9 of the first inner strand layer 3 or are laid the same as the strands 10 of the second inner strand layer 4. The lay direction of the strands of one strand layer can also be different relative to the lay direction of the strands of the other strand layer. The tensile carrier 1 is then no longer stranded in equal lay as illustrated above, but in reverse lay, also termed cross lay. For example, the strands 7 of the outer strand layer 2 can be stranded in the "S" direction and the strands 8, 9 of the first inner strand layer 3 in the "Z" direction and the strands 10 of the second inner strand layer 4 again in the "Z" direction. Tensile carriers stranded in reverse lay are neutral in torque.

Figure 3:
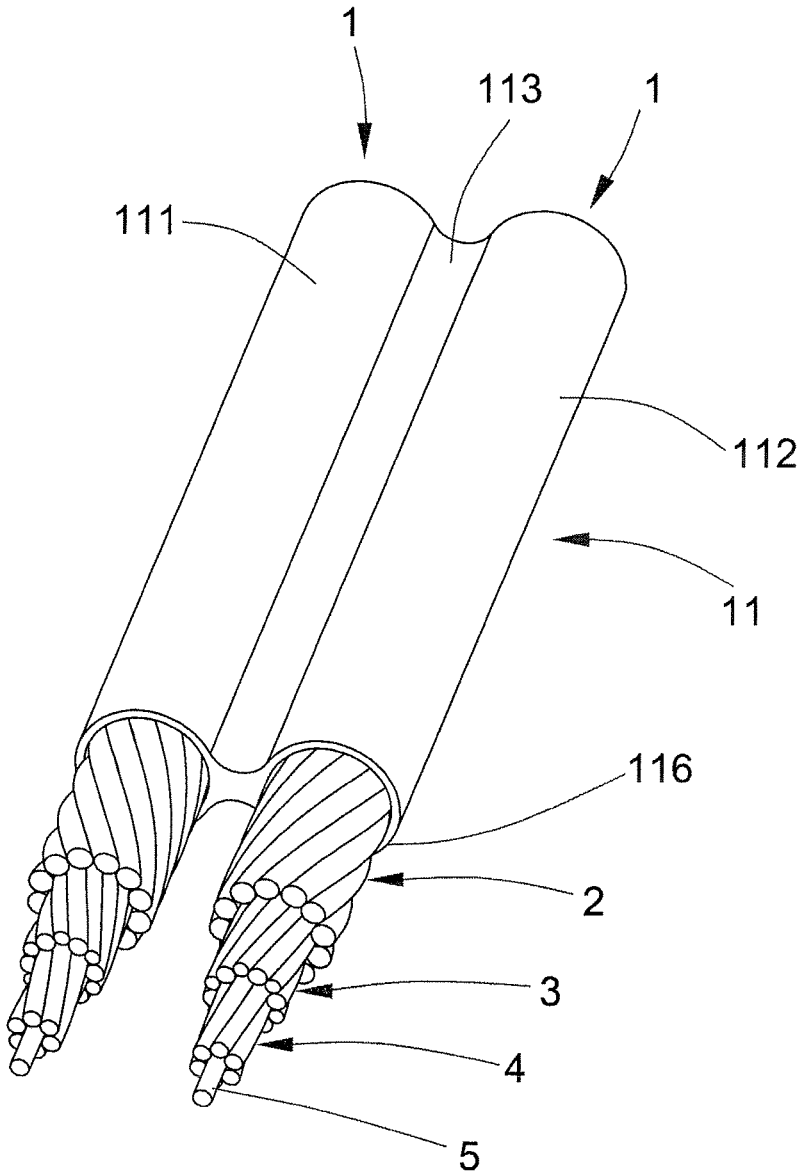
FIG. 3 shows a variant embodiment of a supporting and drive means with at least two tensile carriers according to FIG. 1.

FIG. 3 shows a supporting and drive means 11 with at least two tensile carriers 1 according to FIG. 1, which extend axially parallel to the longitudinal axis of the supporting and drive means. The supporting and drive means 11 have the geometry of a double cable 11 consisting of a cable body 112 or sheathing 112, which encloses the tensile carriers 1 or in which the tensile carriers 1 are embedded. The left-hand tensile carrier 1 is laid in the "Z" direction and the right-hand tensile carrier 1 is laid in the "S" direction. Each tensile carrier comprises several strand layers 2, 3, 4, wherein the strands 7, 8, 9, 10 forming the strand layer are stranded (helical twisting around one another of strands of a strand layer about the strand layer lying thereunder). Synthetic fibers are bundled to form a thread, wherein several threads are stranded in the "S" direction or the "Z" direction to form a strand.

The double cable 111 can, together with the sheathing 112, be constructed as a flat cable or flat belt or have a narrowing 113 between the tensile carriers 1. In the variant with the narrowing 13 the common running surface 116 of the double cable 111 together with the drive pulley is formed, as seen in cross-section, from in each instance approximately a semicircle of the tensile carrier 1 and half the narrowing 113. The profile of the drive pulley or of a deflecting pulley matches the profile of the running surface 116 of the double cable 111 in approximately complementary manner. In addition, more than two tensile carriers 1 can also be encased by a common sheathing and form a multiple cable with or without narrowing 113 between the tensile carriers 1.

The sheathing 112, which is much softer by comparison with the strands 7, extends approximately to the first inner strand layer 3 and has no influence on the mutual supporting of the strand 7. The soft sheathing 6 does not act in circumferential direction Ur as a support between the strands 7. The strands 7 of the outer strand layer 2 are in a position of moving radially inwardly. The sheathing material can, for example, lie in the Shore hardness range 75A to 95A and the matrix material of the strands 7 or the matrix of the strands 7 can, for example, lie in the Shore hardness range of 50D to 75D.

FIGS. 4 and 4A show an example of embodiment of a supporting and drive means 11 with a triple-layered tensile carrier 1 per rib 14 in accordance with FIG. 1. As explained above, the tensile carriers 1 are laid or stranded alternately in the "Z" direction and the "S" direction. The size of the supporting and drive means 11 and the size of the tensile carrier diameter and the strand diameter are indicated in millimeters in FIG. 4A.

FIGS. 5 and 5A show an example of embodiment of a supporting and drive means 11 with one double-layered tensile carrier 1 per rib 14. The outer strand layer 2 has been omitted. Accordingly, strands with larger diameters have been used. As explained above, the tensile carriers 1 are laid or stranded alternately in the "Z" direction and the "S" direction. The size of the tensile carrier diameter and the size of the strand diameter are indicated in millimeters in FIG. 5A. The diameter of the tensile carrier 1 according to FIG. 5 and the diameter of the tensile carrier 1 according to FIG. 6 are identical. The diameters of the comparable strands are different.

The supporting and drive means 11 according to FIGS. 4 and 5 has, for a width of 48 millimeters, a yield force of 60 kN to 90 kN and is suitable for a drive pulley diameter or deflecting pulley diameter equal to or greater than 90 millimeters.

The ratio of the pulley diameter "D" to the tensile carrier diameter "d" is also to be taken into consideration, for example D/d lies in the range of 16 to 45, as well as the desired service life and the desired number of bendings of the supporting and drive means.

FIGS. 6 and 6A show an example of embodiment of a supporting and drive means 11 with two triple-layered tensile carriers 1 per rib 14 according to FIG. 1. As explained above, the tensile carriers 1 are laid or stranded alternately in the "Z" direction and the "S" direction. The size of the tensile carrier diameter and the size of the strand diameter are indicated in millimeters in FIG. 6A.

FIGS. 7 and 7A show an example of embodiment of a supporting and drive means 11 with two double-layered tensile carriers per rib 14. The outer strand layer 2 has been omitted. Accordingly, strands with larger diameter have been used. As explained above, the tensile carriers 1 are laid or stranded alternately in the "Z" direction and the "S" direction. The sizes of the tensile carrier diameter and the strand diameter are indicated in millimeters in FIG. 7A. The diameter of the tensile carrier 1 according to FIG. 7 and the diameter of the tensile carrier 1 according to FIG. 8 are identical. The diameters of the comparable strands are different.

The tensile carriers 1 of FIGS. 6 and 7 have a substantially smaller diameter than the tensile carriers 1 of FIGS. 4 and 5.

The supporting and drive means 11 according to FIGS. 6 and 7 have, for a width of 48 millimeters, a yield force of 60 kN to 90 kN and are suitable for a drive pulley diameter or deflecting pulley diameter equal to or greater than 90 millimeters. Also to be taken into consideration are the ratio of the pulley diameter to the tensile carrier diameter and the desired service life or the desired number of bendings of the supporting and drive means.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A flat belt supporting and drive means having at least two tensile carriers of synthetic fibers, wherein the tensile carriers extend at a spacing from one another axially parallel to a longitudinal axis of the supporting and drive means and are embedded in a sheathing, comprising: each of at least two tensile carriers includes a plurality of strands arranged in at least one strand layer, wherein each said strand is formed from a plurality of stranded threads, which are embedded in a matrix material and constructed from synthetic fibers, and a Shore hardness of the sheathing is approximately equal to a Shore hardness of said matrix material thereby improving a connection between the sheathing and said matrix material.

2. The supporting and drive means according to claim 1 wherein said sheathing has a Shore hardness in a range of 80A to 95A and said matrix material has a Shore hardness in a range of 80A to 95A.

3. The supporting and drive means according to claim 1 having a geometry of a belt including a belt body or a sheathing enclosing the at least two tensile carriers or in which the at least two tensile carriers are embedded and which has a running surface.

4. The supporting and drive means according to claim 3 wherein the stranding is neutral in terms of torque in an "S" direction and a "Z" direction of the at least two tensile carriers in the belt relative to the longitudinal axis extending in the center of the belt.

5. The supporting and drive means according to claim 4 wherein each of the at least two tensile carriers, is stranded in reverse lay or a lay direction of the strands of one strand layer is different from a lay direction of the strands of another strand layer.

6. The supporting and drive means according to claim 4 wherein a lay length of said strand layers is dependent on a diameter of a drive pulley or a deflecting pulley, on a necessary number of the lay lengths resting on the drive pulley or the deflecting pulley, wherein the necessary number of the lay lengths is from 2 to 5, on an E modulus of the synthetic fibers, and on an angle of wrap of the flat belt supporting and drive means on the drive pulley or the deflecting pulley.

7. The supporting and drive means according to claim 1 wherein a running surface of the belt is flat or has ribs and grooves, wherein a profile of a drive pulley or of a deflecting pulley is matched in approximately complementary manner to a profile of said running surface of the belt, wherein the drive pulley or the deflecting pulley in co-operation with the belt form a force couple or a shape couple.

8. The supporting and drive means according to claim 7 wherein a ratio, D/d of a drive pulley diameter or a deflecting pulley diameter to a tensile carrier diameter lies in a range of 16 to 50.

9. The supporting and drive means according to claim 7 wherein one of the at least one tensile carrier is provided for each rib.

10. A flat belt supporting and drive means comprising:

a plurality of tensile carriers extending at a spacing from one another axially parallel to a longitudinal axis of the supporting and drive means, each of said tensile carriers including a plurality of strands arranged in at least one strand layer, wherein each said strand is formed from a plurality of stranded threads, which threads are embedded in a matrix material and are constructed from synthetic fibers; and a sheathing in which said tensile carriers are embedded, wherein, a Shore hardness of said sheathing is approximately equal to a Shore hardness of said matrix material thereby improving a connection between said sheathing and said matrix material.

11. The supporting and drive means according to claim 10 wherein the Shore hardness of said sheathing is in a range of 80A to 95A and the Shore hardness of said matrix material is in a range of 80A to 95A.

* * * * *